US009964304B2

(12) United States Patent
Noman

(10) Patent No.: US 9,964,304 B2
(45) Date of Patent: May 8, 2018

(54) COMBUSTION ACOUSTIC NOISE PREVENTION IN A HEATING FURNACE

(75) Inventor: Shiblee S. M. Noman, Frisco, TX (US)

(73) Assignee: Lennox Industries Inc., Richardson, TX (US)

( * ) Notice: Subject to any disclaimer, the term of this patent is extended or adjusted under 35 U.S.C. 154(b) by 791 days.

(21) Appl. No.: 13/556,353

(22) Filed: Jul. 24, 2012

(65) Prior Publication Data

US 2014/0030662 A1 Jan. 30, 2014

(51) Int. Cl.

| | |
|---|---|
| ***F24H 9/20*** | (2006.01) |
| ***F24H 3/06*** | (2006.01) |
| ***F23N 3/08*** | (2006.01) |
| ***F24H 3/08*** | (2006.01) |
| ***F24H 3/10*** | (2006.01) |
| ***F23N 5/20*** | (2006.01) |

(52) U.S. Cl.

CPC ..... *F23N 3/082* (2013.01); *F23N 5/203* (2013.01); *F24H 3/087* (2013.01); *F24H 3/105* (2013.01); *F24H 9/2085* (2013.01); *F23N 2027/02* (2013.01); *F23N 2033/04* (2013.01); *F23N 2033/10* (2013.01); *F23N 2037/10* (2013.01); *F23N 2037/16* (2013.01)

(58) Field of Classification Search

None

See application file for complete search history.

(56) References Cited

U.S. PATENT DOCUMENTS 3,662,738 A * 5/1972 Solka et al. ..... 126/110 R
4,518,345 A * 5/1985 Mueller et al. ..... 431/24
4,703,747 A * 11/1987 Thompson ..... F23N 1/025 126/112
4,729,207 A * 3/1988 Dempsey et al. ..... 126/112
4,815,524 A * 3/1989 Dempsey ..... F23N 5/203 165/245
4,976,459 A * 12/1990 Lynch ..... 236/11
5,027,789 A * 7/1991 Lynch ..... 126/116 A
5,186,386 A * 2/1993 Lynch ..... 236/11
5,248,083 A * 9/1993 Adams et al. ..... 236/11
5,326,025 A * 7/1994 Dempsey et al. ..... 236/11
5,331,944 A * 7/1994 Kujawa ..... F24H 9/2085 126/110 R
5,340,028 A * 8/1994 Thompson ..... 236/10
5,418,438 A * 5/1995 Hollenbeck ..... F23N 1/062 165/246
5,682,826 A * 11/1997 Hollenbeck ..... F23N 1/062 110/147
5,732,691 A * 3/1998 Maiello ..... F23N 1/022 126/110 R
5,791,332 A * 8/1998 Thompson et al. ..... 126/116 A
5,865,611 A * 2/1999 Maiello ..... F23N 5/022 126/110 E
6,161,535 A * 12/2000 Dempsey et al. ..... 126/110 R
6,283,115 B1 * 9/2001 Dempsey et al. ..... 126/110 R
6,321,744 B1 * 11/2001 Dempsey et al. ..... 126/116 A (Continued)

*Primary Examiner* — Avinash Savani
*Assistant Examiner* — Martha Becton
(74) *Attorney, Agent, or Firm* — Winstead PC

(57) ABSTRACT

A control module for preventing acoustic resonance noise generation from a heat exchanger of a heating furnace, comprising a control signal generated by the control module. The control signal is configured to operate an induction fan of the heating furnace at more than one speed for a given heat demand mode of the heating furnace.

11 Claims, 3 Drawing Sheets

(56) References Cited

U.S. PATENT DOCUMENTS

| | | | | |
|---|---|---|---|---|
| 6,925,999 | B2 * | 8/2005 | Hugghins | F23N 1/002 126/110 A |
| 7,101,172 | B2 * | 9/2006 | Jaeschke | F23N 3/08 126/110 R |
| 8,672,670 | B2 * | 3/2014 | Hugghins | F23N 3/082 126/110 R |
| 9,261,277 | B2 * | 2/2016 | Hugghins | F23N 3/002 |
| 9,335,045 | B2 * | 5/2016 | Kowald | |
| 2008/0127963 | A1 * | 6/2008 | Thompson | 126/116 A |
| 2009/0311641 | A1 * | 12/2009 | Berthold et al. | 431/10 |
| 2011/0174201 | A1 * | 7/2011 | Kowald | F23N 3/082 110/186 |

* cited by examiner

COMBUSTION ACOUSTIC NOISE PREVENTION IN A HEATING FURNACE

TECHNICAL FIELD

This application is directed, in general, to heating furnaces and, more specifically, to a method and control module for preventing acoustic noise in heating furnaces.

BACKGROUND

A desirable characteristic of fuel-fired heating furnaces is that the furnace operates quietly and with high energy efficiency. Some heating furnaces, however, can make acoustic noise upon commencing the heating cycle. It is desirable to dampen, suppress or otherwise reduce the noise without substantially compromising the efficiency of the furnace.

SUMMARY

One embodiment of the disclosure is a control module for preventing acoustic resonance noise generation from a heat exchanger of a heating furnace, comprising a control signal generated by the control module. The control signal is configured to operate an induction fan of the heating furnace at more than one speed for a given heat demand mode of the heating furnace.

Another embodiment is a fuel-fired heating furnace. The furnace comprises a heat exchanger assembly and a burner assembly coupled to the heat exchanger assembly and configured to produce a flame within the heat exchanger assembly. The furnace also comprises an induction assembly, the induction assembly including an induction fan configured to draw air through the heat exchanger assembly. The furnace further comprises the above-described control module.

Still another embodiment is a method of preventing acoustic resonance noise generation from a heat exchanger of a fuel-fired heating furnace. The method comprises generating a control signal configured to operate an induction fan of the heating furnace at more than one speed for a given heat demand mode of the heating furnace.

BRIEF DESCRIPTION

Figure 1:
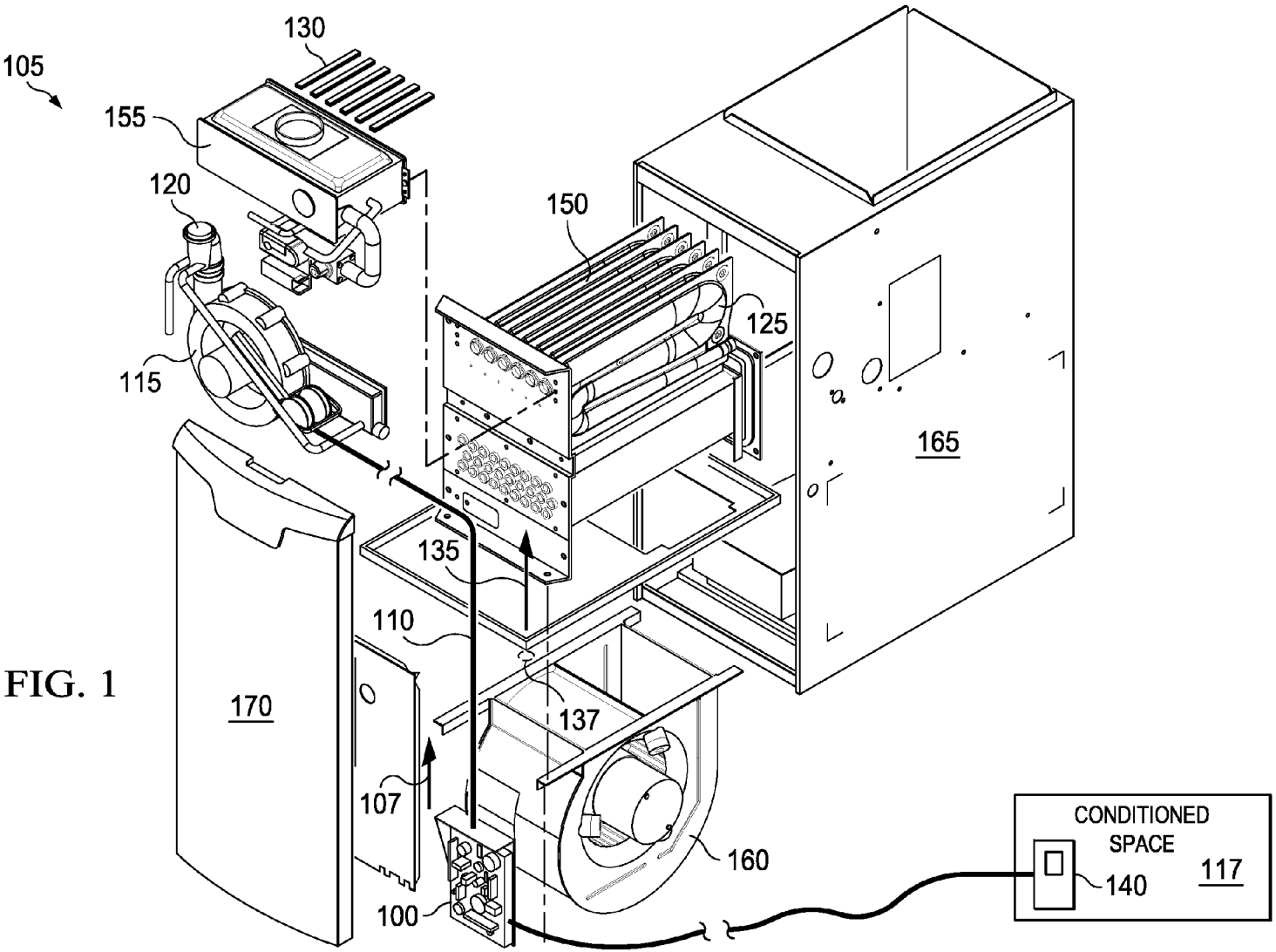
Figure 2:
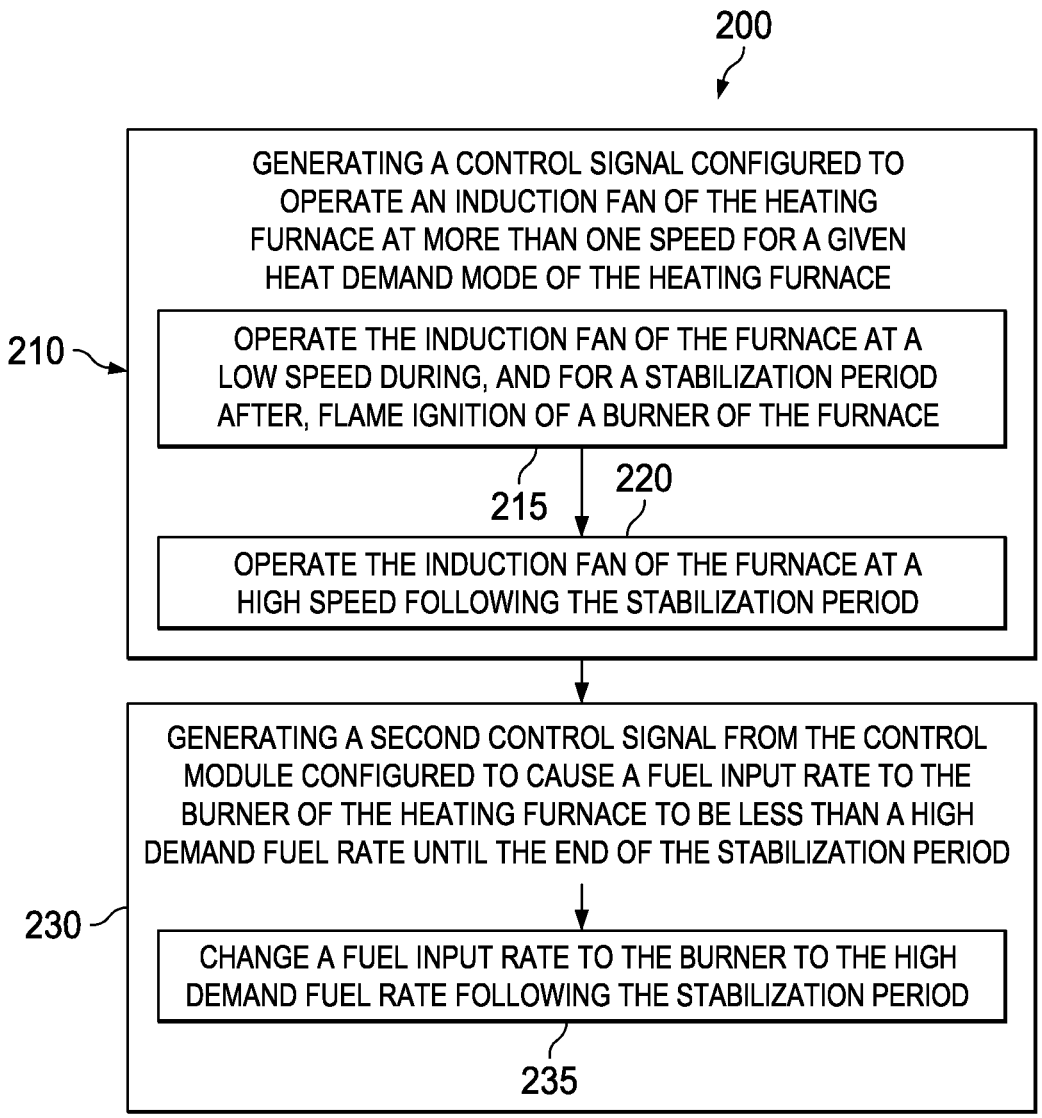
Figure 3:
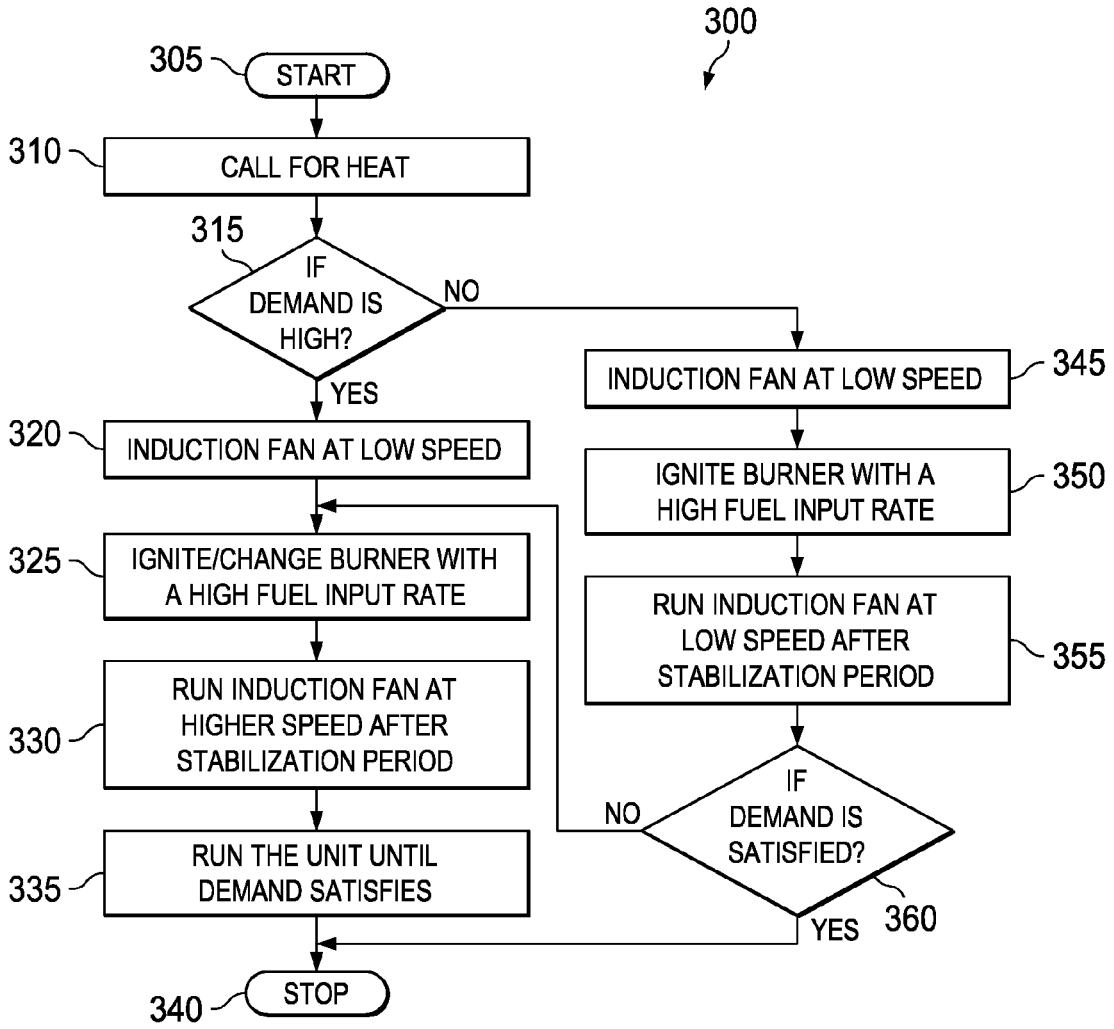

Reference is now made to the following descriptions taken in conjunction with the accompanying drawings, in which:

FIG. 1 illustrates an isometric view of an example fuel-fired heating furnace of the disclosure and an example control module of the of the disclosure;

FIG. 2 presents a flow diagram of an example method of preventing acoustic resonance noise from a heat exchanger of a heating furnace, such as the example embodiments of the furnace, and the control module, depicted in FIG. 1; and FIG. 3 presents a flow diagram of the example operation of single- and multi-stage furnaces with the disclosed control module present, such as any of the example furnaces and control modules depicted in FIGS. 1-2.

DETAILED DESCRIPTION

The term, "or," as used herein, refers to a non-exclusive or, unless otherwise indicated. Also, the various embodiments described herein are not necessarily mutually exclusive, as some embodiments can be combined with one or more other embodiments to form new embodiments.

It was found that a continuous constant-pitched acoustic noise (referred to herein as a "howling noise") can be produced when a furnace commences its heating cycle. As part of the present disclosure, it was discovered that the howling noise originated from within the heat exchanger (e.g., a clamshell, or similar hollow tube types of heat exchangers) of the heating furnace. While not limiting the scope of the inventive disclosure by theoretical considerations, it is thought that the howling noise is caused by acoustic resonant vibration in the heat exchanger.

It is thought that when the burner ignites, an acoustic shockwave is produced, and this source acoustic shockwave enters the inlet of the heat exchanger. The source acoustic shockwave entering the heat exchanger combines with the acoustic noise associated with the rolling flame acoustic noise associated with burning the fuel/air mixture in the vicinity of the burner tube located within the inlet of the heat exchanger. It is thought that the resulting combination produces the acoustic resonant vibration. The particular frequency of the howling noise will be related to the natural acoustic resonance frequency of the, heat exchanger, which in turn depends upon the particular dimensions of the hollow space within the heat exchanger.

It was further discovered, as part of the present disclosure, that reducing or preventing the entry of the source acoustic shockwave into the heat exchanger can prevent the formation of the acoustic resonant vibration. In particular, supplying less air (e.g., primary, secondary or any other air) into the combustion zone at the time of ignition, will reduce the flame turbulence and associated roaring flame noise. Therefore, the triggering source of the howling noise, which is the flame turbulence and associated roaring flame noise, is reduced or stopped. The resultant flame (e.g., with less combustible air than the theoretical optimal amount of air) will have less turbulence, and may look less blue or yellowish. After this less turbulent flame is established, the amount of combustible air can be increased to that which facilitates complete fuel combustion and the reduction of carbon monoxide and other emissions to within allowable standard amounts. It was also found that lowering the speed of an induction fan of a combustion induction assembly coupled to the heat exchanger adequately reduces the flow rate of secondary air into the heat exchanger, thereby preventing the acoustic resonant vibration. The term induction fan, also known as a combustion inducer or draft induction fan, as used herein refers to any air mover or blower device configured to induce a draft to facilitate the movement of combustion gases through a heat exchanger.

Typically, the induction fan speed is designed to ensure adequate secondary air provided to the heat exchange such that the fuel to air ratio at the burner tube can support a hot blue flame, and hence, provide optimal furnace heating efficiency. Therefore, it is counter-intuitive to lower the induction fan speed, and hence provide less than adequate secondary air flow to the heat exchanger, because this would result in a cooler yellow flame, which in turn, provides a sub-optimal furnace heating efficiency. However, it was discovered as part of the present disclosure, that the total time needed to prevent the howling noise, by lowering the induction fan speed, during flame ignition and the stabilization period, is short compared to the total time the furnace remains in a heating mode. Consequently, the methods disclosed herein to prevent the howling noise can be performed without substantially decreasing furnace heating efficiency.

One embodiment of the disclosure is a control module for preventing acoustic resonance noise generation from a heat exchanger of a heating furnace. FIG. 1 illustrates an isometric view of an example control module 100 of the disclosure for an example a fuel-fired heating furnace 105 of the disclosure.

In some case, the control module 100 can be an integral part of the furnace 105, while in other cases, the control module 100 can be a separate after-market control module designed to be connect to and control an already installed furnace 105. In some embodiments, the control module 100 can be part of or integrated into a circuit board having e.g., memory, computing and comparator subunits as well as subunits for receiving data (e.g., from a thermostat) and transmitting control signals. Based on the present disclosure one of ordinary skill would understand how other types of electronic components could be configured to implement the control module's 100 control functions such as presented herein.

With continuing reference to FIG. 1 throughout, the control module 100 generates a control signal 107, e.g., a digital or analog electrical signal, e.g., transmitted wirelessly or through one or more electrically conductive lines 110. The control signal 107 is configured to operate an induction fan 115 of the heating furnace 105 at more than one speed for a given heat demand mode of the heating furnace 105. As illustrated, the induction fan 115 can be part of an induction assembly 120 that is connected to one or more heat exchangers 125 of the furnace 105.

The term heat demand mode, as used herein, refers to a requirement for the heating to a conditioned space 117 such as a room or other enclosed space in a building, house or, similar structure. In some cases, the heat demand mode is defined by the presence of a temperature difference between an ambient temperature and a target temperature of the space 117 conditioned by the heating furnace 105.

In some cases, the heating furnace 105 configured as a single-stage heating furnace responds a single heat demand mode by ignition of a burner 130 of the furnace 105 with a single fixed flow rate of fuel to the burner 130. In some cases, the heating furnace 105, e.g., configured as a multi-stage heating furnace, responds multiple heat demand modes by ignition of a burner 130 of the furnace 105 with two or more different flow rate of fuel to the burner 130, depending upon the magnitude of the heat demand mode.

The term, high heat demand mode, as used herein refers to a condition where a temperature difference between an ambient temperature and a target temperature of the space 117 conditioned by the heating furnace 105 that is sufficiently large to cause the heating furnace 105 to operate at 100 percent of the furnace's 105 top rated heat output. The high heat demand mode, in turn, causes the fuel flow to the burner 130 of the furnace 105 to be supplied at a rate that supports the furnace operating in the high demand mode with an optimal fuel to air ratio.

In comparison, the term, low heat demand mode, as used herein refers to a condition where there is a smaller temperature difference between the ambient temperature and the target temperature of the conditioned space 117 at less than 100 percent (e.g., at least 10 percent less, in some cases) of the furnace's 105 top rated heat output. The low heat demand mode causes the fuel flow to the burner 130 of the furnace 105 to be supplied at a lower rate to support the furnace operating in the low demand mode with an optimal fuel to air ratio.

As noted above, unlike the typical operation of a fuel-fired furnace, the control module 100 of the disclosure causes the induction fan 115 to operate at more than one speed for a given heat demand mode of the heating furnace 105. In particular, at least one of the more than one fan speeds is lower than a speed needed to supports the optimal fuel to air ratio for the particular demand mode that the furnace 105 is operating in response to.

Consider, for example, an embodiment of the furnace 105 configured as a single-stage heating furnace, and hence, has a single demand mode corresponding to the maximum rated thermal output (e.g., 100 percent of the top rated heat output) of the heating furnace 105. Typically, a single-stage heating furnace has an induction fan configured to operate at a single speed to support the optimal fuel to air ratio when the single-stage heating furnace is heating in response to a heating demand. In contrast, the control module 100 of the disclosure causes the induction fan 115 to operate at least two different speeds for the single heat demand mode of the single-stage heating furnace 105. For instance, the control signal 107 generated by the control module 100 is configured to cause the induction fan 115 to operate at a low speed during, and for a stabilization period after, flame ignition of the burner 130 coupled to the heat exchanger 125 of the heating furnace 105. The low speed is less than a higher speed designed to support the heating furnace 105 operating at a maximum rated thermal output.

One of ordinary skill in the art would understand that the specific higher speed setting of the fan 115, to support the heating furnace 105 operating at the maximum rated thermal output, would depend upon a number of factors, such as but not limited to, the size of the heat exchanger 125, the type of primary fuel (e.g., methane, ethane, propane, butane), the rate of fuel delivered to the burner 130, and, the amount of air present in the primary fuel. For instance, for some embodiments of the furnace 105, configured as a single-stage heating furnace, the high speed of the fan 115 is a value in a range of 2000 to 4000 rpm.

Similarly, one of ordinary skill would appreciate that the specific lower speed setting of the fan 115 would depend upon what the specific higher fan speed setting was equal to, and upon the percent reduction from the higher speed needed to prevent the howling noise. For instance, in some embodiments, the lower fan speed is a least about 25 percent lower than the higher fan speed. For instance, in some embodiments, the lower speed is a value in a range from about 25 percent less to about 75 less than the higher fan speed.

As noted above, in some embodiments, it is advantageous to extend the low speed of the fan 115 for a stabilization period after flame ignition of a burner 125. Having the stabilization period helps to ensure prevention of the howling noise. For instance, in some embodiments, the stabilization period is at least about 3 seconds. For instance, in some embodiments, the stabilization period is a value in a range from 5 to 60 seconds.

In some embodiments, it is advantageous for the control signal 107 generated by the control module 100 to activate the induction fan 115 before flame ignition in the burner 130. Activating the induction fan 115 before flame ignition helps to ensure that any residual combustion products are evacuated from the heat exchanger 125.

In some cases, before flame ignition, the fan 115 is turned on for a period (e.g., a value in a range from 10 seconds to 60 second, in some cases) at the low speed setting, so that the fan speed does not have to be changed to the desired low speed setting upon flame ignition. In such embodiments, turning on the fan 115 at the low speed setting before flame ignition still allows residual combustion products to be evacuated before flame ignition, while facilitating the prevention of the howling noise.

In some embodiments, it is advantageous for the control signal 107 generated by the control module 100 to be further configured to cause the induction fan 115 (e.g., via the control signal 107) to operate at the high speed following the stabilization period. Operating the fan 115 at the high speed following the stabilization period helps to ensure adequate air to support the production of the hot blue flame, and hence, optimal furnace heating efficiency, after the occurrence of the howling noise has been prevented.

In some embodiments, such as when the heating furnace 105 is configured as a multi-stage heating furnace, the control module 100 can be further configured to generate a second control signal 135 (e.g., a digital or analog electrical signal transmitted wirelessly or through electrically conductive lines 137) configured to cause a fuel input rate to the burner 130 to be less than a fuel input for a high heat demand rate until the end of the stabilization period. For instance, during the stabilization period, the heating furnace 105 operates as it would in response to a low heat demand mode, even when the actual heating demand is a high heat demand.

In some embodiments, the second control signal 135 is further configured to cause the fuel input rate to the burner to change to the high demand fuel rate following the stabilization period. For instance, the second control signal can be configured to cause the change to the high demand fuel rate when a thermostat 140 in communication with the control module 100 signals that the heat demand mode is a high demand mode. For instance, the thermostat 140 can signal the presence of a large temperature difference between an ambient temperature and a target temperature of the conditioned space 117, thereby causing the control module 100 operate the furnace 105 at 100 percent of its rated thermal output.

FIG. 1 illustrates another embodiment of the disclosure a fuel-fired heating furnace 105. The furnace 105 comprises a heat exchanger assembly 150, which in some cases, can include a plurality of the heat exchangers 125. The furnace 105 also comprises a burner assembly 155 coupled to the heat exchanger assembly 150 and configured to produce a flame within the heat exchanger assembly 150. For instance, each one of the burners 130 of the burner assembly 155 can extend into each one of the heat exchangers 125. The furnace 105 further comprises an induction assembly 120. The induction assembly 120 includes an induction fan 115 configured to draw air through the heat exchanger assembly 150. For instance, each of the heat exchangers 125 can be coupled to the induction assembly 120 such that, when the induction fan 115 is turned on, air is drawn through each heat exchanger 125.

The furnace 105 further comprises a control module, including any of the embodiments of the control module 100 described above in the context of FIG. 1.

For instance, the control module 100 is configured to generate a control signal 107, the control signal 107 configured to operate the induction fan 115 at more than one speed for a given heat demand mode of the furnace 105 (e.g., configured as either a single-stage or a multi-stage furnace). For instance, in some embodiments, the control signal 107 generated by the control module 100 is configured to cause the induction fan 115 to operate at a low speed during, and for a stabilization period after, flame ignition with the burner assembly 155. The low speed is less than a high speed designed to support the heating furnace 105 operating at a maximum rated thermal output. For instance, in some embodiments, such as when the heating furnace 105 is configured as a multi-stage heating furnace, the control module 100 further generates a second control signal 135. The second control signal 135 is configured to cause a fuel input rate to the burner assembly to be less than a high demand fuel rate until the end of the stabilization period.

In some cases for any such embodiments of the furnace 105, a magnitude of acoustic resonance noise generated within the heat exchanger assembly 150 (e.g., within individual heat exchangers 125 of the heat exchanger assembly 150) is suppressed by at least about 99 percent, as compared to a magnitude of the acoustic resonance noise generated within the heat exchanger assembly 150 when the induction fan 115 operates at the high speed during flame ignition and the stabilization period.

One of ordinary would appreciate that the furnace 100 could include additional components to facilitate its operation including, but not limited to a blower assembly 160, and cabinet assembly 165 and a cover assembly 170.

Still another embodiment of the disclosure is a method of preventing acoustic resonance noise from a heat exchanger of a fuel-fired heating furnace. FIG. 2 presents a flow diagram of an example method 200 of preventing acoustic resonance noise generation from a heat exchanger of a heating furnace, such as the example embodiments of the furnace 105, and, the control module 100 depicted in FIG. 1.

With continuing reference to FIG. 1, throughout, as illustrated in FIG. 2, the method 200 includes a step 210 of generating a control signal 107 configured to operate an induction fan 115 of the heating furnace 105 at more than one speed for a given heat demand mode of the heating furnace 105

In some embodiments, as part of step 210, the control signal causes, in step 215, the induction fan 115 of the furnace 105 to operate at a low speed during, and for a stabilization period after, flame ignition of a burner 130 coupled to the heat exchanger 125 of the heating furnace 105. The low speed is less than a high speed designed to support the heating furnace 100 operating at a maximum rated thermal output. In some embodiments, as part of step 210, the control signal 107 causes, in step 220, the induction fan 115 to operate at the high speed following the stabilization period.

In some embodiments, the method 200 further includes a step 230 of generating a second control signal 135 from the control module 105. The second control signal 135 is configured to cause a fuel input rate to the burner 130 of the heating furnace 105, e.g., configured as a multi-stage heating furnace, to be less than a high demand fuel rate until the end of the stabilization period. In some embodiments, the second control signal 135 is further configured to cause, in step 235, a fuel input rate to the burner 130 to change to the high demand fuel rate following the stabilization period, e.g., in cases where the heating demand mode is a high heating demand.

FIG. 3 presents a flow diagram of the example operation of single- and multi-stage furnaces with the disclosed control module present, such as any of the example furnaces 105 and control modules 100 discussed in the context of FIGS. 1-2. The operation commences at start step 305. In step 310 there is a call for heat, e.g., from a thermostat 140.

For a single-stage furnace 105, the call for heat in step 310 is considered in step 315 to be high heat demand mode. In step 320 the induction fan 115 is operated at the low speed and in step 325 the burner 130 is ignited with a high fuel input rate (e.g., a rate appropriate to support a high heat demand mode). After a stabilization period following ignition, in step 330, the induction fan 115 is operated at the higher speed. The furnace unit 105 is operation until the heat demand is satisfied in step 335 after which the furnace turns off at stop step 340.

For a multi-stage furnace 105, the call for heat in step 310 can be a high or low heat demand mode. In the case where it is determined, in step 315, that the heat demand mode is low, then in step 345 the induction fan 115 is operated at the low speed and in step 350 the burner 130 is ignited as a high gas input rate (e.g., a rate appropriate to support a low heat demand mode). After a stabilization period following ignition, in step 355, the induction fan 115 is continued to operate at the lower speed for a predefined period of time set for the multi-stage furnace 105. If, after the predefined period it is determined, in step 360, that the heat demand is satisfied then furnace 105 is turned off in stop step 340. If the heat demand is determined, in step 360 not to be satisfied then the in step 325 the burner 130 is changed to a high fuel input rate (e.g., a rate appropriate to support a high heat demand mode) and the in step 330, the induction fan 115 is operated at the higher speed. The furnace unit 105 is operation until the heat demand is satisfied in step 335 after which the furnace turns off at stop step 340.

Those skilled in the art to which this application relates will appreciate that other and further additions, deletions, substitutions and modifications may be made to the described embodiments.

What is claimed is:

1. A control module for preventing acoustic resonance noise generation from a heat exchanger of a heating furnace, comprising:

a circuit board, the circuit board configured to operate an induction fan of the heating furnace at more than one speed for a given heat demand mode of the heating furnace and further configured, in response to a request for a high heat demand mode, to cause the induction fan of the furnace to operate at a low speed during, and for a stabilization period after, flame ignition of a burner coupled to the heat exchanger of the heating furnace, the circuit board further configured to cause a fuel input rate to the burner of the heating furnace, configured as a multi-stage heating furnace, to be less than a fuel input rate for the high heat demand mode until the end of the stabilization period;

wherein the low speed is less than a higher speed designed to support the heating furnace operating at a maximum rated thermal output, and wherein the circuit board is further configured to cause the induction fan to operate at the high speed following the stabilization period.

2. The control module of claim 1, wherein the heating furnace is a single-stage heating furnace having a single demand mode corresponding to the maximum rated thermal output of the heating furnace.

3. The control module of claim 1, wherein the low speed is a value in a range from about 25 percent less to about 75 less than the higher speed.

4. The control module of claim 1, wherein the stabilization period is at least about 3 seconds.

5. The control module of claim 1, wherein the stabilization period is a value in a range from 5 to 60 seconds.

6. The control module of claim 1, wherein the circuit board is further configured to cause the fuel input rate to the burner to change to the high demand fuel rate following the stabilization period.

7. The control module of claim 1, wherein the circuit board is further configured to cause the change to the high demand fuel rate when a thermostat in communication with the control module signals that the heat demand mode is a high demand mode.

8. A fuel-fired heating furnace, comprising:

heat exchanger assembly;

a burner assembly coupled to the heat exchanger assembly and configured to produce a flame within the heat exchanger assembly;

an induction assembly, the induction assembly including an induction fan configured to draw air through the heat exchanger assembly; and a control module configured to operate the induction fan at more than one speed for a given heat demand mode of the heating furnace, and further configured, in response to a request for a high heat demand mode, to cause the induction fan to operate at a low speed during, and for a stabilization period after, flame ignition within the burner assembly, the control module further configured to cause a fuel input rate to the burner of the heating furnace, configured as a multi-stage heating furnace, to be less than a fuel input rate for the high heat demand mode until the end of the stabilization period;

wherein the low speed is less than a high speed designed to support the heating furnace operating at a maximum rated thermal output, and wherein the circuit board is further configured to cause the induction fan to operate at the high speed following the stabilization period.

9. A method of preventing acoustic resonance noise generation from a heat exchanger of a fuel-fired heating furnace, comprising:

providing an induction fan of the heating furnace capable of operating at more than one speed for a given heat demand mode of the heating furnace;

receiving a request for a high heat demand mode;

operating the induction fan of the furnace at a low speed during, and for a stabilization period after, flame ignition of a burner coupled to the heat exchanger of the heating furnace, wherein the low speed is less than a high speed designed to support the heating furnace operating at a maximum rated thermal output;

supplying fuel to the burner of the heating furnace at a fuel input rate that is less than a high heat demand mode fuel input rate until the end of the stabilization period;

causing the induction fan to operate at the high speed following the stabilization period.

10. The method of claim 9, further comprising supplying fuel at the high demand mode fuel input rate following the stabilization period.

11. The method of claim 9, further comprising supplying fuel at the high demand fuel rate when the heat demand mode is a high demand mode.

* * * * *